US005801672A

United States Patent [19]

Masuda et al.

[11] Patent Number: 5,801,672

[45] Date of Patent: Sep. 1, 1998

[54] DISPLAY DEVICE AND ITS DRIVING METHOD

[75] Inventors: Youichi Masuda; Nozomu Harada, both of Yokohama; Hiroki Nakamura, Chigasaki, all of Japan

[73] Assignee: Kabushiki Kaisha Toshiba, Kawasaki, Japan

[21] Appl. No.: 432,165

[22] PCT Filed: Sep. 9, 1994

[86] PCT No.: PCT/JP94/01502

§ 371 Date: May 8, 1995

§ 102(e) Date: May 8, 1995

[87] PCT Pub. No.: WO95/07493

PCT Pub. Date: Mar. 16, 1995

[30] Foreign Application Priority Data

| | | | |
|---|---|---|---|
| Sep. 9, 1993 | [JP] | Japan | 5-224313 |
| Sep. 14, 1993 | [JP] | Japan | 5-228747 |
| Sep. 14, 1993 | [JP] | Japan | 5-228758 |
| Feb. 14, 1994 | [JP] | Japan | 6-017141 |

[51] Int. Cl.[6] ..... G09G 3/36

[52] U.S. Cl. ..... 345/98; 345/100

[58] Field of Search ..... 345/87, 94, 98, 345/99, 100, 103, 204, 208, 132; 348/790, 792; 359/84, 85, 87

[56] References Cited

U.S. PATENT DOCUMENTS

| | | | |
|---|---|---|---|
| 4,807,974 | 2/1989 | Hirai . | |
| 4,935,731 | 6/1990 | Takebe et al. | 345/132 |
| 4,990,902 | 2/1991 | Zenda | 345/132 |

FOREIGN PATENT DOCUMENTS

| | | |
|---|---|---|
| 0 456 165 | 11/1991 | European Pat. Off. . |
| 60-26932 | 2/1985 | Japan . |
| 62-271569 | 11/1987 | Japan . |
| 63-218927 | 9/1988 | Japan . |
| 4165329 | 6/1992 | Japan . |
| 6-28424 | 4/1994 | Japan . |
| 6-28425 | 4/1994 | Japan . |
| 6-28426 | 4/1994 | Japan . |

OTHER PUBLICATIONS

Reita, "Integrated Driver Circuits for Active Matrix Liquid Crystal Displays", vol. 14, No. 2, 1993, Jordan Hill, Oxford GB.

Nakamura et al., "33-inch, 1.9MPixel Integrated Driver Poly-Si TFT-LCD for HDTV Projector", IEEE International Solid State Circuits Conference, vol. 37, Feb. 1994, pp. 154, 155, 328.

*Primary Examiner*—Regina Liang

*Attorney, Agent, or Firm*—Cushman Darby & Cushman IP Group of Pillsbury Madison & Sutro LLP

[57] ABSTRACT

A display device comprises a display panel, a scanning circuit section for supplying a scanning signal to scanning lines of the display panel, and a scanning control circuit section for supplying an n-bit (n: 2 or more positive integer) input numeral signal and an inverted replica of the input numeral signal to the scanning circuit section. In the display device, a scanning circuit section comprises an input connection line group having sets of input connection lines for receiving bits of the input numeral signal and bits of the inverted replica of the input numeral signal, a plurality of logic circuit sections, less in number than the scanning lines, for responding to combinations of the input numeral signal and its inverted replica, and an output distributing unit for assigning an output from one logic circuit section to at least two scanning lines. It is, therefore, possible to suppress an increase in the number of connection lines and of the logic circuit sections involving a high definition of a display device and hence to manufacture a display device in a high yield.

18 Claims, 10 Drawing Sheets

DISPLAY DEVICE AND ITS DRIVING METHOD

DESCRIPTION

1. Technical Field

The present invention relates to a display device such as a liquid crystal display device which includes a plurality of display pixels arranged in a matrix array, and its driving method.

2. Background Art

A liquid crystal display device has been used in many fields, such as a television, computer display and electronic notebook, and particular attention has been paid to liquid crystal display devices having light weight, small thickness and low power dissipation.

In a liquid crystal projector, for example, white color light from a light source is spectrally divided by a dichroic mirror, etc., into three primary colors, red, green and blue. These light color-components are incident on three independent liquid crystal devices to display a red, a green and a blue image, and these display images are again optically combined to project a resultant image on a transmission or a reflection screen for color display.

A liquid crystal display device for a liquid crystal projector has to meet the requirements that an incident optical system and projection optical system be made small without increasing their size. It is also required that, because the display image on the liquid crystal display device is projected in an enlarged form onto a screen, the display device be made compact and the display pixels be made at a fine pitch.

Attempts have been made, in such a liquid crystal display device, to form a display panel constructed of a plurality of display pixels, as well as a drive circuit section driving these display pixels, as one unit over a substrate to eliminate cumbersome interconnection between the display panel and the drive circuit section.

The drive circuit section of the above-mentioned display device is comprised mainly of a shift register array where normally a plurality of shift registers are connected in one array. This is disclosed, for example, SID 93 DIGEST p383–p386 "A 1.9-in.1.5-MPixel Driver Fully-Integrated Poly-Si TFT-LCD for HDTV Projection".

However, since the shift register array is a type that transfers a signal sequentially through these shift registers, if there are any defects, such as shorting, in part of the shift register array, then all the downstream shift registers fail.

In order to eliminate this drawback, for example, Jpn. Pat. Appln. KOKAI Publication No. 62-271569 discloses using, as a drive circuit section of the display device, a driver circuit comprised of one pair of decoders instead of shift register for outputting sequential pulses on the basis of a binary count value for counting a clock pulse and its inverted replica.

If the drive circuit section is comprised mainly of decoders, when there is any break or shorting in part of the interconnection, an output is not obtained at an area corresponding to any defect area, but it is possible to secure adequate reliability by, for example, providing one pair of decoders as a redundant unit in the drive circuit.

In the arrangement disclosed in Jpn. Pat. Appln. KOKAI Publication No. 62-271569, however, the decoder has a plurality of logic circuit sections each corresponding to one scanning line or one signal line and, hence, not only the number of connection lines for transmitting numeral signals but also the number of logic circuit sections is increased as definition of the display device increases and, conversely, this causes a fall in a manufacturing yield. Further, since the respective logic circuit sections are arranged to correspond to one scanning line or one signal line each, no adequate measure can be taken against high-speed operation requirements resulting from the high definition of the display device.

A method is known by which, in the case where the number of effective scanning lines of a video signal, for example, is less than the number of horizontal pixel lines, the display panel's horizontal pixel lines remaining as ones not corresponding to the effective scanning lines of the video signal are scanned during a vertical blanking period, etc., to display a black blank display. In the above-mentioned arrangement, it is difficult to scan all the remaining horizontal pixel lines in a very brief period of time. It is, therefore, not possible to expect any positive black display.

The object of the present invention is to provide a display device to solve the above-mentioned technical task, according to which it is possible to markedly reduce any operation error.

Another object of the present invention is to provide a display device and drive method which can obtain a better display image even when the number of horizontal pixel lines of the display panel and number of effective scanning lines, or the number of the display pixels in one horizontal pixel line and number of video data of the video signal, differ.

DISCLOSURE OF INVENTION

A display device of the present invention comprises:

- a display panel having a plurality of signal lines and plurality of scanning lines arranged in a matrix, a plurality of switching elements electrically connected to the signal lines and scanning lines, and pixel electrodes connected to the switching elements;
- a scanning circuit section for supplying scanning signals to the scanning lines; and
- a scanning control circuit section for supplying an n-bit input numeral signal (n: 2 or more positive integer) and an inverted replica of the input numeral signal to the scanning circuit section, wherein the scanning circuit section comprises

- input connection line group having sets of input connection lines for receiving bits of the input numeral signal and bits of the inverted replica of the input numeral signal,
- a plurality of logic circuit sections, less in number than the scanning lines, for responding to combinations of the input numeral signal and the inverted replica of the input numeral signal, and
- output distributing means for assigning an output from one logic circuit section to at least two scanning lines.

Further, a display device of the present invention comprises:

- a display panel having a plurality of signal lines and plurality of scanning lines arranged in a matrix, switching elements electrically connected to the signal lines and scanning lines and pixel electrodes connected to the switching elements;
- a select control circuit section for generating an n-bit input numeral signal (n: 2 or more positive integer) and an inverted replica of the input numeral signal; and a video signal supplying circuit section for selecting, in a predetermined timing, input video signals based on the input numeral signal and the inverted replica of the input numeral signal from the select control circuit section and supplying selected video signals to the signal line as video data, wherein the video signal supplying circuit section comprises an input connection line group having sets of input connection lines for receiving bits of the input numeral signal and bits of the inverted replica of the input numeral signal, a plurality of logic circuit sections, less in number than the scanning lines, for responding to combinations of the input numeral signal and the inverted replica of the input numeral signal, and output distributing means for assigning an output from one logic circuit section to at least two signal lines.

A method of the present invention is provided for driving a display device for forming a display image based on video data of a video signal on a display panel including an array of horizontal pixel lines each formed of a plurality of display pixels, the method comprising the steps of, when the number of effective scanning lines in one vertical scanning period of the video signal is less than the number of the corresponding horizontal pixel lines, displaying non-display data on at least one horizontal pixel line not corresponding to the effective scanning line of the video signal in a first period containing one vertical scanning period, and displaying non-display data on the other horizontal pixel lines not corresponding to the effective scanning line of the video signal in a second period containing another vertical scanning period different from the one vertical scanning period.

Further, a method of the present invention is provided for driving a display device for forming a display image based on video data of a video signal on a display panel including an array of horizontal pixel lines each formed of a plurality of display pixels, the method comprising the steps of, when the number of the video data in one horizontal scanning period of the video signal is less than the number of the display pixels of the horizontal pixel line, displaying non-display data on at least one display pixel not corresponding to the video data in a first period, and displaying non-display data on another display pixel not corresponding to the video data in a second period different from the first period.

According to the display device of the present invention, since the scanning circuit section or video signal supplying circuit section includes fewer logic circuit sections less in number than the scanning lines or signal lines to be selected on the basis of an input numeral signal from the select control circuit, it is possible to, for the high definition of the display device, prevent an increase in the number of connection lines for transmitting the numeral signal and the number of logic circuit sections and hence to manufacture a display device in a better yield. Further, using fewer number of logic circuit sections makes it possible to suppress the operation frequency of the numeral signal to a low extent and to provide an allowance for element designing.

According to the method for driving the display device of the present invention, even if the number of the horizontal pixel lines of the display panel and effective scanning lines of the video signal differ or if the number of the display pixels in one horizontal pixel line and number of video data of the video signal, differ, non-display data is displayed in a first period on at least one horizontal pixel line not corresponding to the effective scanning line of the video signal, in a second period different from the first period, on another horizontal pixel line not corresponding to the effective scanning line of the video signal, or non-display data is displayed, in a first period, on at least one display pixel not corresponding to the video data and in a second period different from the first period, on another display pixel not corresponding to the video data. By doing so, non-display data can be displayed on the non-display areas.

The scanning circuit section or video signal supply circuit section in the display device is comprised of logic circuit sections for selectively producing outputs on the basis of an input numeral signal from the select control circuit section. By doing so, the above-mentioned drive method can be readily realized in a simple arrangement.

BRIEF DESCRIPTION IF THE DRAWINGS

BEST MODE OF CARRYING OUT THE INVENTION

A liquid-crystal projector according to one embodiment of the present invention will be explained below with reference to the accompanying drawings.

Figure 1:
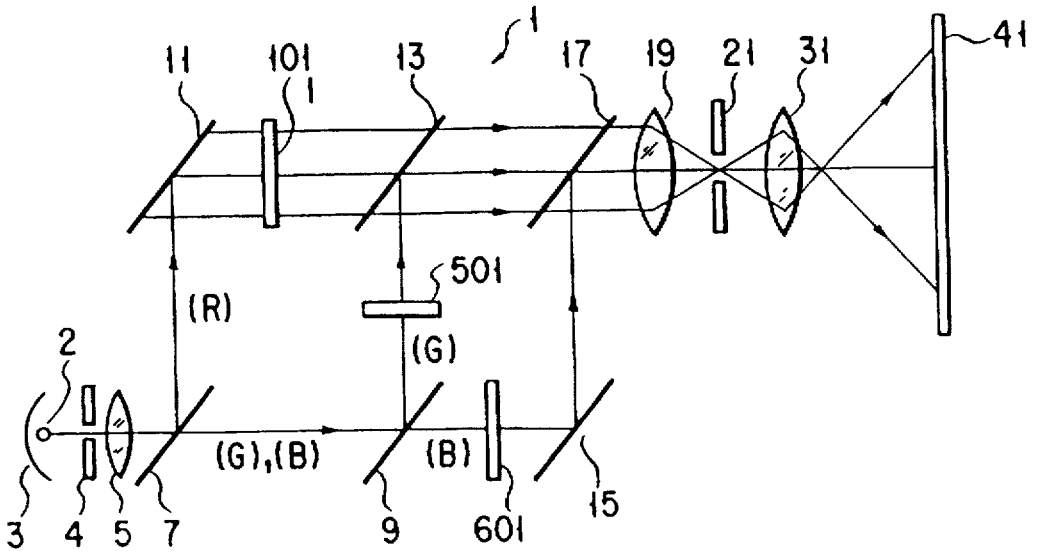
FIG. 1 is a view schematically showing an arrangement of a liquid crystal projector according to one embodiment of the present invention.

FIG. 1 is a view schematically showing an arrangement of the liquid crystal projector 1. The liquid crystal projector 1 comprises a light source 2, a reflection mirror 3 for reflecting a light source beam directed toward a back surface of the light source 2, a first aperture mask 4 for narrowing down the light beam coming from a light source 2, a light source optical lens 5 for allowing the light source beam which passes through the aperture mask 4 to appear as parallel beams, a first dichroic mirror 7 for allowing a red-color component R in the light beam which passes through the light source optical lens 5 to be reflected and green and blue color components G and B to be transmitted, a first reflection mirror 11 for allowing the red color component R which is reflected by the first dichroic mirror 7 to be guided to a liquid crystal display device 101 for red color display, a second dichroic mirror 9 for allowing only a green color component G in the transmitted beam which is transmitted through the first dichroic mirror 7 to be reflected and guiding it to a liquid crystal display device 501 for green color display and for allowing the blue color component B to be transmitted and guiding it to a liquid crystal display device 601, a third dichroic mirror 13 for allowing a video image which is transmitted through the liquid crystal display device 501 to be combined with a video image transmitted through the liquid display device 101, a second reflection mirror 15 for allowing a video image which is transmitted through the liquid crystal display 601 to be combined with a video image transmitted through the liquid crystal display device 101 and a fourth dichroic mirror 17. The video image thus combined is condensed by a condensing lens 19 and, after passing through an aperture in a second aperture mask 21, projected on a projection lens 31.

Figure 2:
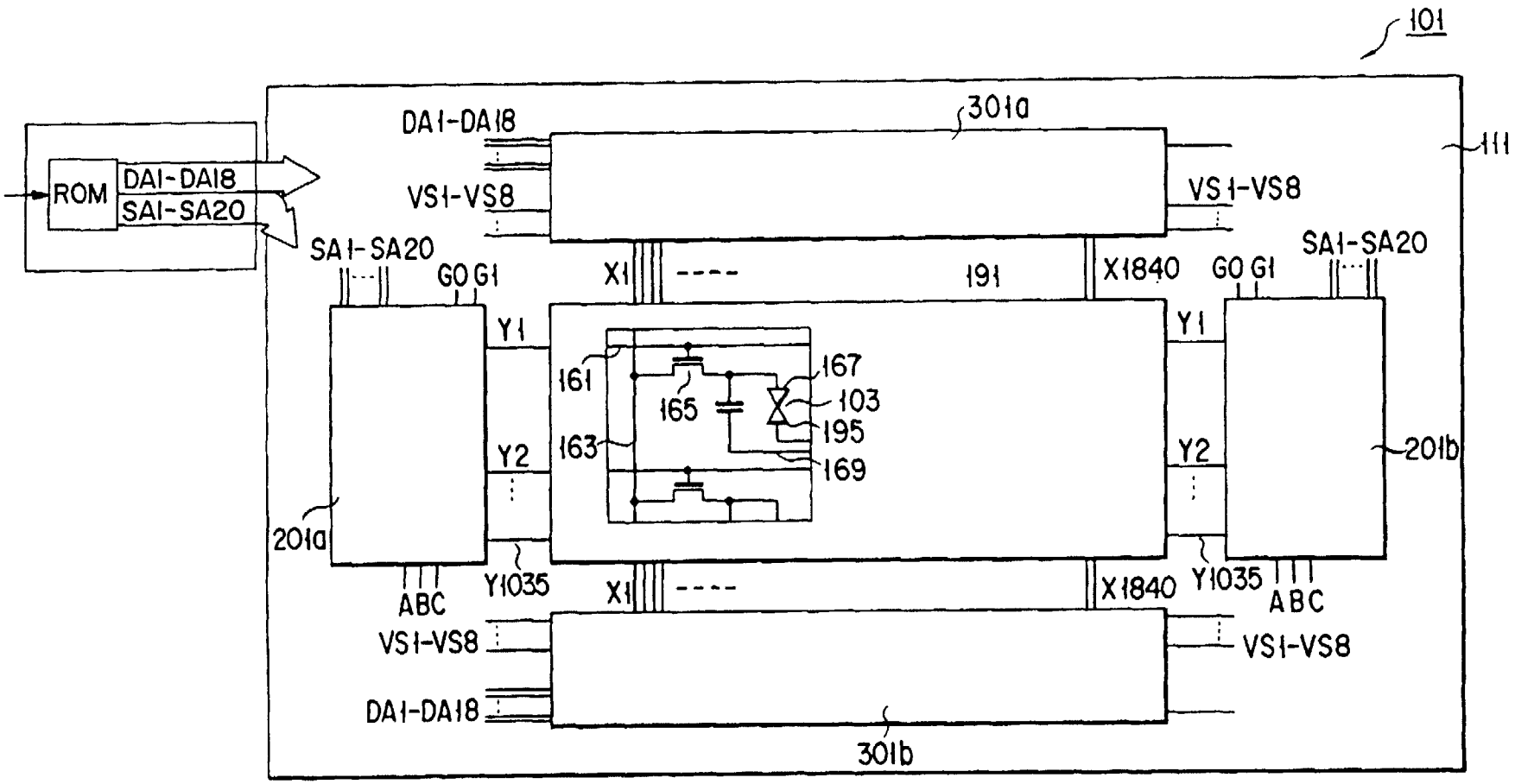
FIG. 2 is a view schematically showing an arrangement of a liquid crystal device shown in FIG. 1.

FIG. 2 is a view schematically showing an arrangement of the liquid crystal display device 101 in FIG. 1. The other liquid crystal display devices 501 and 601 are substantially the same as the liquid crystal display device 101 and any further explanation is, therefore, omitted.

The liquid crystal display device 101 has one pair of electrode substrates 111 and 191 and a high polymer molecule dispersed-type nematic liquid crystal cell 103 held between the substrates 111 and 191. The liquid crystal cell 103 comprises a high polymer molecular resin material and an anisotropic nematic liquid crystal having a positive permittivity dispersed in the high polymer molecular resin material.

One electrode substrate 111 includes, over a quartz transparent insulating substrate, one set of scanning line drive circuits 201*a* and 201*b* arranged on the left and right sides of the liquid crystal cell 103 in a redundant way, one set of video signal line drive circuits 301*a* and 301*b* arranged on the upper and lower sides of the liquid crystal cell 103 in a redundant way, 1035 scanning lines 161 (Yj: j=1, 2, . . . , 1035) connected to one set of scanning line drive circuits 201*a* and 201*b*, respectively, and 1840 video signal lines 163 (Xi: i=1, 2, . . . , 1840) connected to another set of video signal line drive circuits 301*a* and 301*b*. Thin-film transistors (hereinafter referred to as TFTs) are electrically connected at their gates to the scanning lines 161 and at their drains to the video signal lines 163 and formed of polysilicon. Further, pixel electrodes 167 are electrically connected to the sources of the TFTs 165 and comprised of ITO (Indium-Tin-Oxide) and subsidiary capacitive lines 169 are integrally arranged substantially parallel to the scanning lines 161 to each form a subsidiary capacitance CS electrically connected in parallel to the pixel electrode 167.

The other electrode 191 are so arranged as to provide a common electrode 195 over the transparent insulating substrate, the common electrode being formed of ITO.

In the liquid crystal display devices 101, 501 and 601, 1840 display pixels are each comprised of a high polymer molecule dispersed-type nematic liquid crystal cell 103 held between the pixel electrode 167 and the common electrode 195 and 1035 horizontal pixel lines are provided, the same thing can also be said of a display image which, when transmitted, is projected on the respective liquid crystal display devices 101, 501 and 601.

Figure 3:
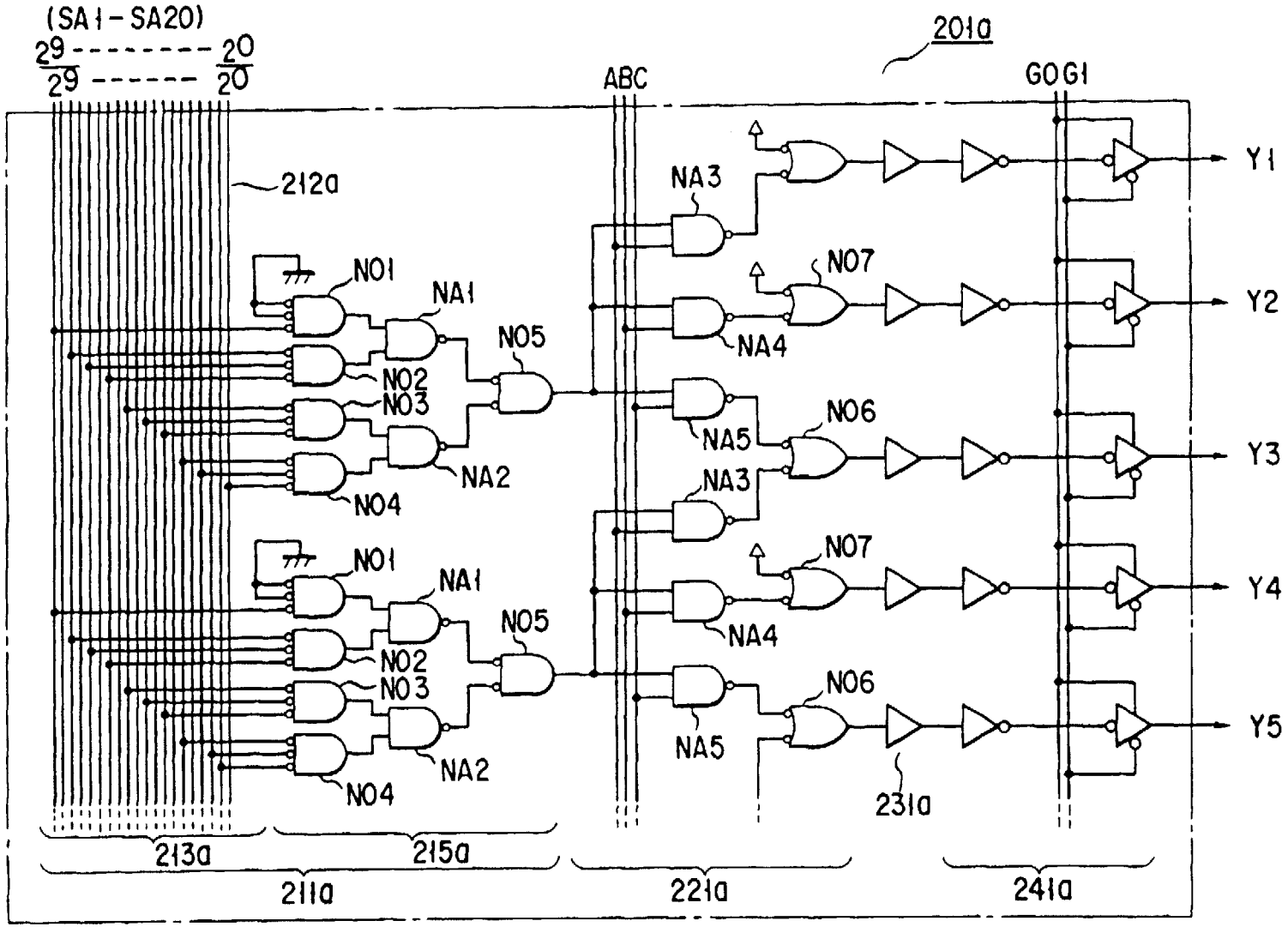
FIG. 3 is a view schematically showing an arrangement of a scanning line drive circuit shown in FIG. 2.

One scanning line drive circuit 201*a* will be explained below with reference to FIG. 3. In this embodiment, since the scanning line drive circuit 201*a* is substantially the same in structure as the other scanning line drive circuit 201*b*, any further explanation of the drive circuit 201*b* is omitted.

The scanning line drive circuit 201*a* comprises a numeral signal converting circuit section 211*a*, a scanning select circuit section 221*a* connected to the numeral signal converting circuit section 211*a*, buffer amplifiers 231*a* connected to the scanning select circuit section 221*a*, and an output control circuit section 241*a* connected to the buffer amplifiers 231*a*.

The numeral signal converting circuit section 211*a* comprises 20 numeral signal lines 212*a* having 10 non-inverted signal lines for supplying a 10-bit digital numeral signal SA1–SA10 and 10 inverted signal lines for supplying a digital numeral signal SA11–SA20, which is an inverted replica of the digital numeral signal SA1–SA10 , stages of logic circuit sections 215*a* each including a set of three-input NOR gates NO1–NO4, and stages of matrix connection section 213*a* each connecting those selected from the non-inverted and inverted signal lines in each common bit to the three-input NOR gates NO1 to NO4 in the logic circuit section 215*a* of a corresponding stage.

The 10-bit non-inverted and inverted signal lines are selected as a different combination for each matrix connection section 213*a*. In a first stage matrix connection section 213*a* for example, selection is made of a 10th-bit ($2^9$) non-inverted signal line, a 9th-bit ($2^8$) non-inverted signal line, a 8th-bit ($2^7$) non-inverted signal line, a 7th-bit ($2^6$) non-inverted signal line, a 6th-bit ($2^5$) non-inverted signal line, a 5th-bit ($2^4$) non-inverted signal line, a 4th-bit ($2^3$) non-inverted signal line, a 3rd-bit ($2^2$) non-inverted signal line, a 2nd-bit ($2^1$) non-inverted signal line and a 1st-bit ($2^0$) inverted signal line. In the second stage matrix connection section 213*a*, selection is made of a 10th-bit ($2^9$) non-inverted signal line, a 9th-bit ($2^8$) non-inverted signal line, a 8th-bit ($2^7$) non-inverted signal line, a 7th-bit ($2^6$) non-inverted signal line, a 6th-bit ($2^5$) non-inverted signal line, a 5th-bit ($2^4$) non-inverted signal line, a 4th-bit ($2^3$) non-inverted signal line, a 3rd-bit ($2^2$) non-inverted signal line, a 2nd-bit ($2^1$) inverted signal line and a 1st-bit ($2^0$) non-inverted signal line.

The logic circuit sections 215*a* have, for example, 518 stages, the number of which is smaller than that of 1035 scanning lines 161 (Yj: j=1, 2, . . . , 1035). The logic circuit section of each stage includes four 3-input NOR gates NO1 to NO4, two 2-input NAND gates NA1 and NA2 and one 2-input NOR gates NO5. The outputs of the NOR gates NO1 and NO2 are connected to first and second input terminals of NAND gates NA1. The outputs of the NOR gates NO3 and NO4 are connected to first and second input terminals of NAND gates NA2. The output terminals of the NAND gates NA1 and NA2 are connected to first and second input terminals of the NOR gate NO5.

The output signal of the NOR gate NO5 of each logic circuit section 215*a* is supplied to the scanning select circuit 221*a*. In the scanning select circuit section 221*a*, the output signal of the NOR gate NO5 of each logic circuit section 215*a* is divided into three parts and supplied to first input terminals of the first, second and third 2-input NAND gates NA3 to NA5. Second input terminals of these NAND gates NA3 to NA5 are connected to three scanning lines A, B and C. The output terminal of the first NAND gate NA3 is connected to a second input terminal of a 2-input NOR gate NO6, which is also provided for a NAND gate NA5 of the preceding stage logic circuit section 215*a*. The output terminal of the second NAND gate NA4 is connected to a first input terminal of a 2-input NOR gate NO7. A second input terminal of the NOR gate 7 is connected to a power supply terminal set at an ON level. The output terminal of the third NAND gate NA5 is connected to a first input terminal of another 2-input NOR gate NO6, which is provided also for a NAND gate NA3 of the subsequent stage logic circuit section 215*a*.

The output signals of NOR gates NO6 and NO7 are fed through the buffer amplifiers 231*a* to the output control circuit section 241*a*. The output control circuit section 241*a* is controlled by output control signals VG0 and VG1 fed respectively through output control lines G0 and G1. The output control signal VG1 is an inverted replica of the output control signal VG0, and the output control circuit section 241*a* determines on the basis of the output signals VG0 and VG1 whether or not the buffer amplifier 231*a* is to be connected to a corresponding scanning line 161.

In a case where a defective operation occurs, for example, in the one-side scanning line drive circuit 201*a*, the scanning line drive circuit 201*a* is electrically disconnected from the scanning line 161, so that the other-side scanning line drive circuit 201*b* can operate without being adversely affected by the one-side scanning line drive circuit 201*a*.

Figure 4:
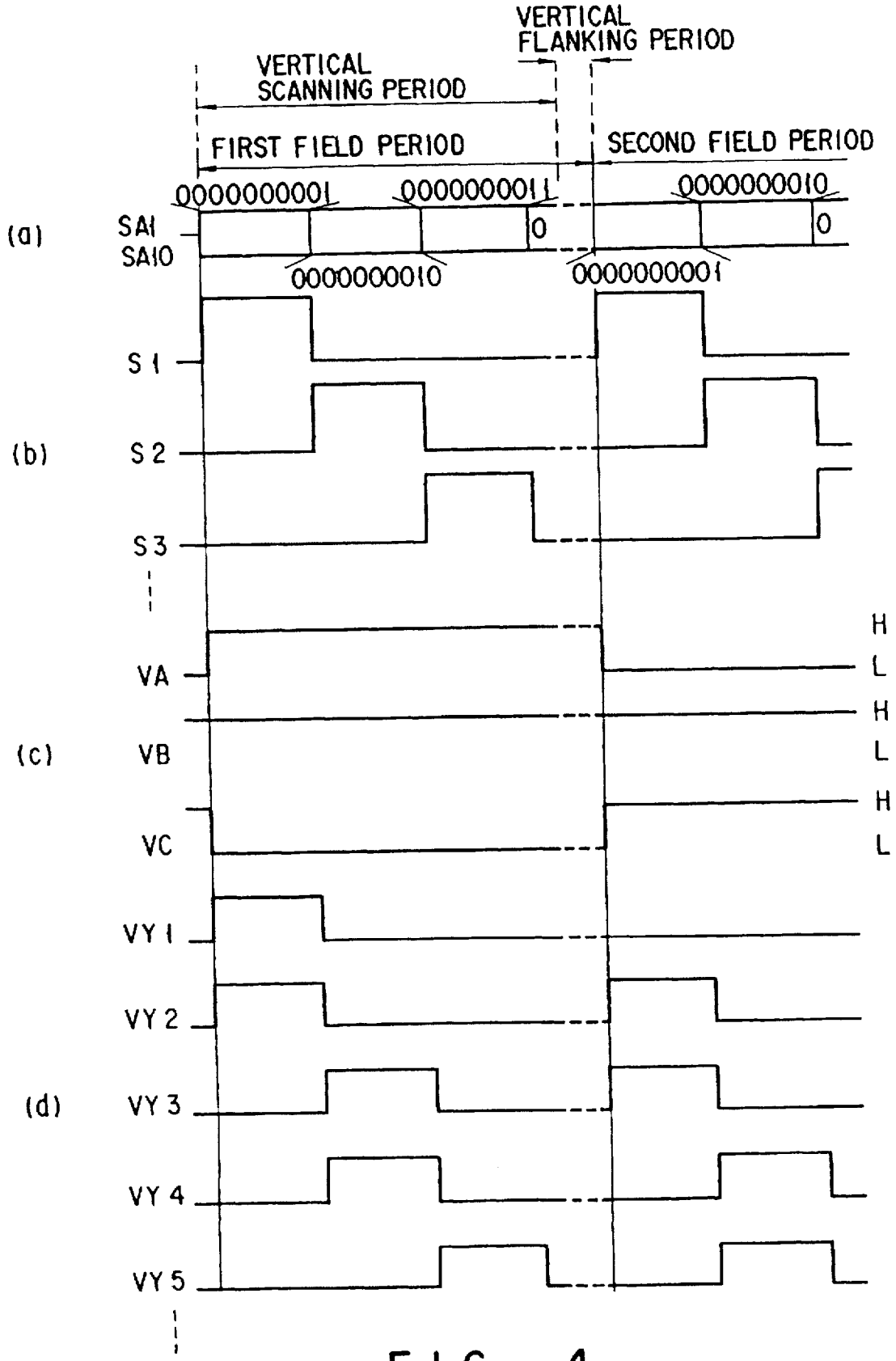
FIG. 4 is a view schematically showing an arrangement of a video signal line drive circuit shown in FIG. 2.

With reference to FIG. 4, explanation will be given below about a case where the scanning line driving circuit 201*a* is used for a two-line-at-a-time drive operation for selecting the scanning lines two by two to appropriately display the video signal VS over TV broadcasting, etc., and simultaneously driving the two scanning lines of each selection, wherein the selection is made such that the combination of two scanning lines is different between an odd-number field period and even-number field period.

The numeral signal lines 212*a* receives a 10-bit digital numeral signal SA1–SA10 from a count circuit or the like and a 10-bit digital numeral signal SA10–SA20 from the count circuit or the like via an inverting output circuit. The digital numeral signal SA1–SA10 is sequentially added as {0000000001}, {0000000010} {0000000011}, . . . for every two horizontal scanning period as shown in FIG. 4(*a*), and the respective bits thereof are supplied to a $2^9$ signal line, $2^8$ signal line, $2^7$ signal line, $2^6$ signal line, $2^5$ signal line, $2^4$ signal line, $2^3$ signal line, $2^2$ signal line, $2^1$ signal line and $2^0$ signal line of the numeral signal lines 212*a*. The inverted digital numeral signal SA11–SA20 is sequentially subtracted as {1111111110}, {1111111101}, {1111111100} . . . (not shown), and the respective bits thereof are supplied to a $2^9$ inverted signal line, $2^8$ inverted signal line, $2^7$ inverted signal line, $2^6$ inverted signal line, $2^5$ inverted signal line, $2^4$ inverted signal line, $2^3$ inverted signal line, $2^2$ inverted signal line, $2^1$ inverted signal line and $2^0$ inverted signal line of the numeral signal lines 212*a*. For example, when the digital numeral signal SA1–SA10 from the count circuit emerge as a {0000000001} shown in FIG. 4(*a*), a {0} is supplied to the $2^9$ signal line, $2^8$ signal line, $2^7$ signal line, $2^6$ signal line, $2^5$ signal line, $2^4$ signal line, $2^3$ signal line, $2^2$ signal line, $2^1$ signal line and $2^0$ inverted signal line, and a {1} is supplied to the $2^9$ inverted signal line, $2^8$ inverted signal line, $2^7$ inverted signal line, $2^6$ inverted signal line, $2^5$ inverted signal line, $2^4$ inverted signal line, $2^3$ inverted signal line, $2^2$ inverted signal line, $2^1$ inverted signal line and $2^0$ signal line.

When a {0000000001} is input as the digital numeral signal SA1–SA10 , only an output S1 is obtained from the first stage of the numeral signal converting circuit section 211*a*, as shown in FIG. 4(*b*). Similarly, when the digital numeral signal SA1–SA10 is output as a {0000000010} from the count circuit, then a {0} is supplied to the $2^9$ signal line, $2^8$ signal line, $2^7$ signal line, $2^6$ signal line, $2^5$ signal line, $2^4$ signal line, $2^3$ signal line, $2^2$ signal line, $2^0$ signal line and $2^1$ inverted signal line of the numeral signal line 212*a* and a {1} is supplied to the $2^9$ inverted signal line, $2^8$ inverted signal line, $2^7$ inverted signal line, $2^6$ inverted signal line, $2^5$ inverted signal line, 24 inverted signal line, $2^3$ inverted signal line, $2^2$ inverted signal line, $2^0$ inverted signal line and $2^1$ signal line. In consequence, only an output S2 is obtained from the second stage of the numeral signal converting circuit section 211*a* upon the inputting of the digital numeral signal {0000000010}.

As shown in FIG. 4(*c*), a select signal VA is applied to the first scanning select line A, noting that it is placed in an ON level during the first field period and in an OFF level during the second field period; a select signal VB which is placed at a given ON level is applied to the second scanning select line B; and an inverted replica VC of the select signal VA is applied to the third scanning select line C.

Using the output S of the numeral signal converting circuit section and respective select signals VA, VB and VC of the respective scanning select lines A, B and C, a scanning signal VYj is output to two adjacent scanning lines 161 for each horizontal scanning period, as shown in FIG. 4(*d*). The combination of two scanning lines 161 selected at a time is made different between the first and second field periods.

Figure 5:
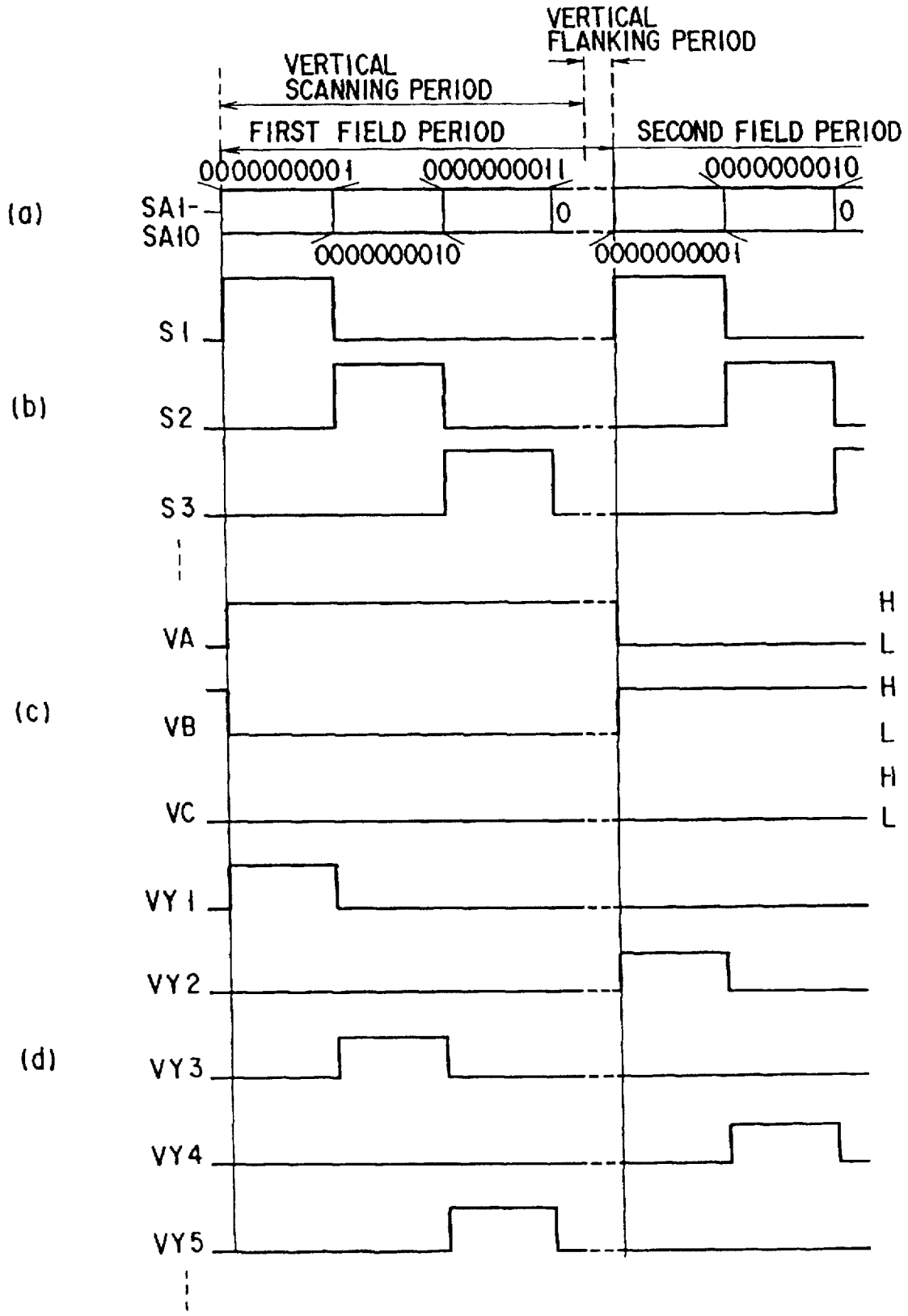
FIG. 5 is a view showing one drive waveform diagram of the scanning line drive circuit shown in FIG. 2.

With reference to FIG. 5, explanation will be given below about a case where the scanning drive circuit 201*a* is used for an interlace drive operation of selectively scanning the odd-number scanning lines during the odd-number field period and the even-number scanning lines during the even-number field period in an alternate way to appropriately display the video signal VS on television broadcast, etc.

When the 10-bit digital numeral signal SA1–SA10 and 10-bit inverted digital numeral signal SA11–SA20 are input to the numeral signal lines 212*a* as in the same way as set out above, outputs S as shown in FIG. 5(*b*) is obtained from the respective stages of the numeral signal converting circuit section 211*a*.

As shown in FIG. 5(*c*), a select signal VA, which is placed in the ON level during the first field period and in the OFF level during the second field period, is supplied to the first scanning select line A, an inverted replica VB of the select signal VA is supplied to the second scanning select line B and a select signal VC of a given OFF level is supplied to the third scanning select line C.

Scanning signals VYj are output from the scanning lines 161, on every other for each horizontal scanning period, according to the output of the numeral signal converting circuit section 211*a* and select signals VA, VB and VC on the scanning select lines A, B and C as shown in FIG. 5(*d*). A different select scanning 161 is made on the first field period and on the second field period.

Figure 6:
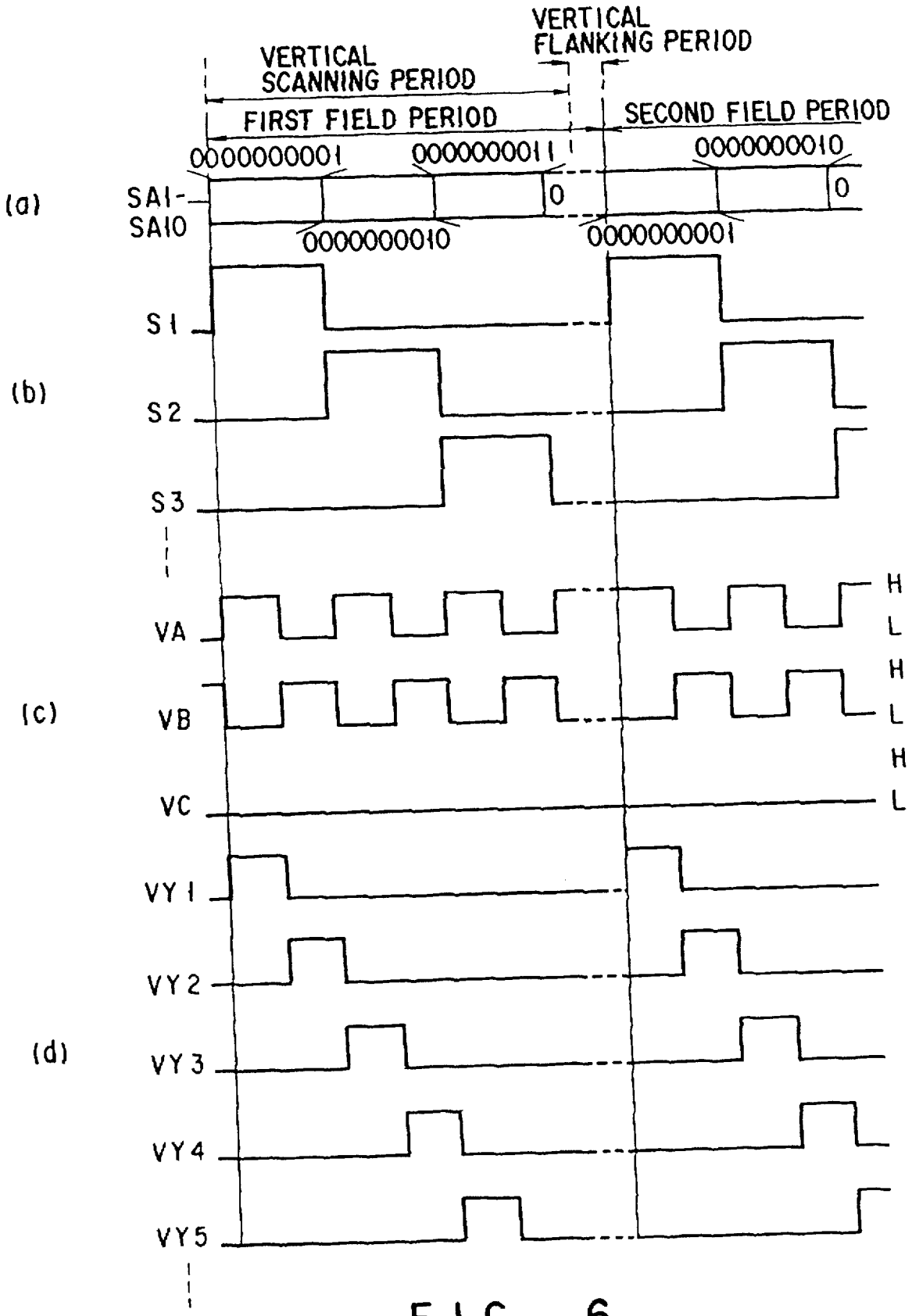
FIG. 6 is a view showing another drive waveform diagram of the scanning line drive circuit shown in FIG. 2.

With reference to FIG. 6, explanation will be given below about the case where the scanning line drive circuit 211*a* is used for a sequential drive operation of selecting all the scanning lines during each vertical scanning period to appropriately display the video signal VS, such as a computer signal.

When, as in the same way as set out above, 10-bit digital numeral signal SA1–SA10 and 10-bit inverted digital numeral signal SA11-SA20 are input to the numeral signal lines 212*a* as shown in FIG. 6(*a*), outputs S shown in FIG. 6(*b*) are obtained from the respective stages of the numeral signal converting circuit 211*a* as shown in FIG. 6(*b*).

As shown in FIG. 6(*c*), a select signal VA for varying one period to one-half horizontal scanning period is applied to the first scanning select line A, an inverted replica VB of the select signal VA is supplied to the second scanning select line B and a select signal VC for taking a given OFF level is applied to the third scanning line C.

Scanning signals VYj which are for sequentially selectively scanning two scanning lines during one horizontal scanning period, are output from the scanning lines 161 according to the output of the numeral signal converting circuit section 211*a* and select signals VA, VB and VC on the scanning select lines A, B and C as shown in FIG. 6(*d*).

A two-lines-at-a-time drive, interlace drive and sequential scanning drive operations can be selected in accordance with the input digital numeral signal SA1–SA10 and scanning select signals VA, VB and VC on the scanning select lines A, B and C in the manner explained above.

Figure 7:
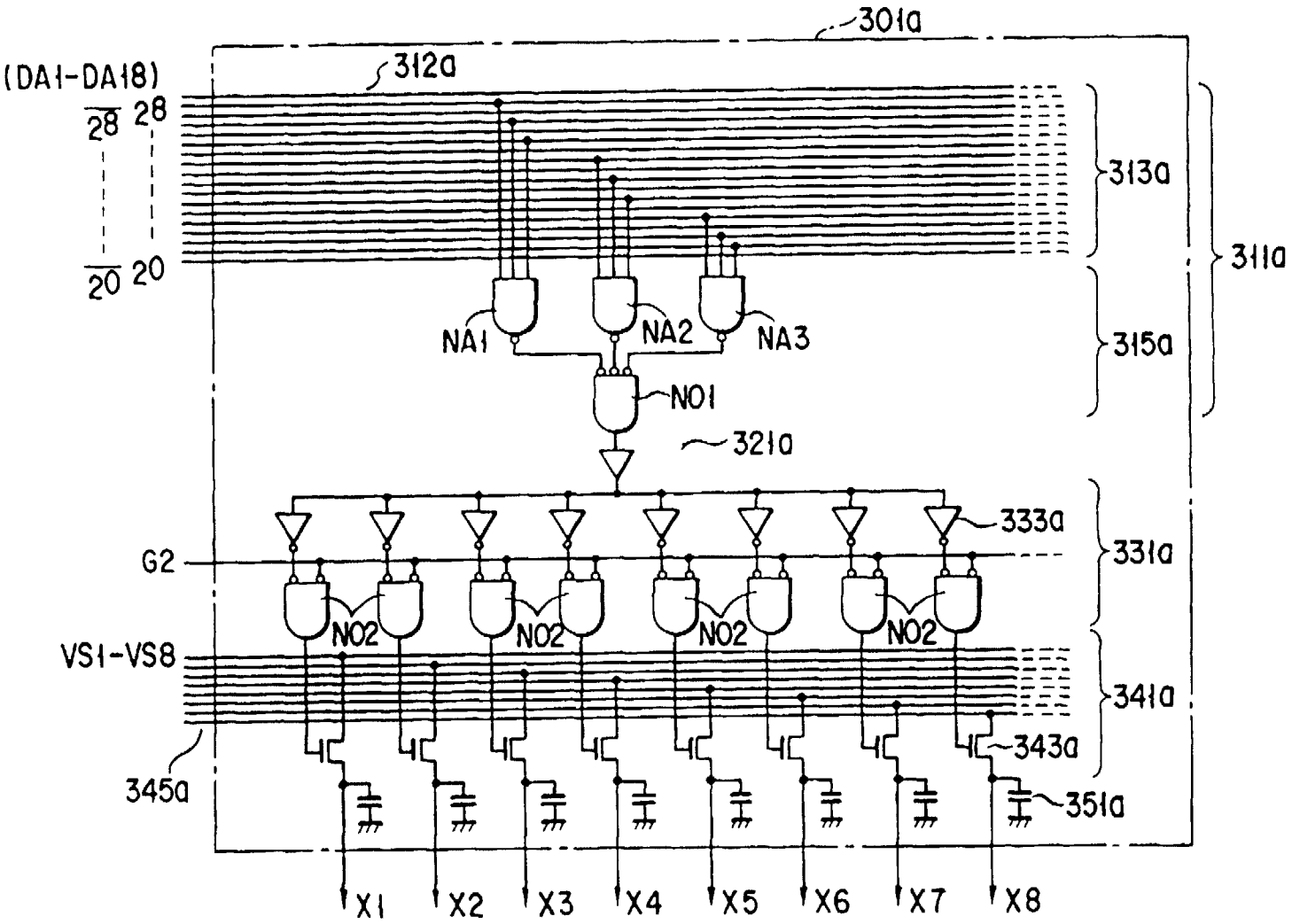
FIG. 7 is a view showing another drive waveform of the scanning line drive circuit shown in FIG. 2.

With reference to FIG. 7, the video signal line drive circuit 301*a* of the liquid crystal display device 101 will be explained below In this embodiment, since the video signal line drive circuit 301*a* has substantially the same arrangement as the other video signal line drive circuit 301*b*, any further explanation of the drive circuit 301*b* is omitted.

The video signal line drive circuit 301*a* comprises a numeral signal converting circuit section 311*a* having both a matrix connection section 313*a* and logic circuit sections 315*a*, buffer amplifiers 321*a* connected to the numeral signal converting circuit 311*a*, an output control circuit section 331*a* connected to the buffer amplifiers 321*a*, a video signal select circuit 341*a* connected to the output control circuit section 331*a*, and a storage capacitance section 351*a*.

The numeral signal conversion circuit section 311*a* comprises 18 numeral signal lines 312*a*. There are nine non-inverted signal lines for supplying a 9-bit digital numeral signal DA1–DA9 and nine inverted signal lines for supplying an inverted replica DA10–DA18 of the digital numeral signal DA1–DA9, stages of logic circuit sections 315*a*, each including a set of 3-input NAND gates NA1–NA3, and stages of matrix connection sections 313*a* connecting each line selected from the non-inverted and inverted signal lines in the respective common bits to the 3-input NAND gates NA1–NA3 of a corresponding stage.

The 9-bit non-inverted and inverted signal lines are selected in a different combination for each matrix connection section 313*a*. In the first stage matrix connection section, for example, a 9th-bit ($2^8$) inverted signal line, 8th-bit ($2^7$) inverted signal line, 7th-bit ($2^6$) inverted signal line, 6th-bit ($2^5$) inverted signal line, 5th-bit ($2^4$) inverted signal line, 4th-bit ($2^3$) inverted signal line, 3rd-bit ($2^2$) inverted signal line, 2nd-bit ($2^1$) inverted signal line and 1st-bit ($2^0$) non-inverted signal line are selected. In the second stage matrix connection section 313*a*, though being not shown, a 9th-bit ($2^8$) non-inverted signal line, 8th-bit ($2^7$) non-inverted signal line, 7th-bit ($2^6$) non-inverted signal line, 6th-bit ($2^5$) non-inverted signal line, 5th-bit ($2^4$) non-inverted signal line, 4th-bit ($2^3$) non-inverted signal line, 3rd-bit ($2^2$) non-inverted signal line, 2nd-bit ($2^1$) inverted signal line, and 1st-bit ($2^0$) non-inverted signal line are selected.

Each logic circuit section 315*a* comprises three 3-input NAND gates NA1–NA3 and one 3-input NOR gate NO1. The output terminals of the NAND gates NA1–NA3 are connected to first, second and third input terminals of the 3-input NOR gate NO1. The output signal of the NOR gate NO1 is fed through the buffer amplifier 321*a* to the output control circuit section 331*a*. In the output control circuit section 331*a*, the output signal of the NOR gate NO0 of each logic circuit section 315*a* is divided into eight ones which are supplied via corresponding buffer amplifiers 333*a* to first input terminals of eight 2-input NOR gates NO2. An output control line G2 is connected to second input terminals of the NOR gates NO2.

The output signals of the NOR gate NO2 are supplied as output signals of the output control circuit section 331*a* to the video signal select circuit section 341*a* where they are input to the gates of eight analog switches 343*a* provided for video data selection. The drains of these analog switches 343*a* are connected to eight video signal input lines 345*a* and, when the respective outputs S of the output control circuit section 331*a* are placed in an ON period, video signals VS1, . . . , VS8 are sample-output from the sources of the analog switches 343*a*. Each video data VD sampled by the video signal select circuit section 341*a* is supplied to the corresponding video signal line 163 via the storage capacitance section 351*a* for storing the data.

The operation of the video signal line drive circuit 301*a* will be explained below with reference to FIG. 8.

Figure 8:
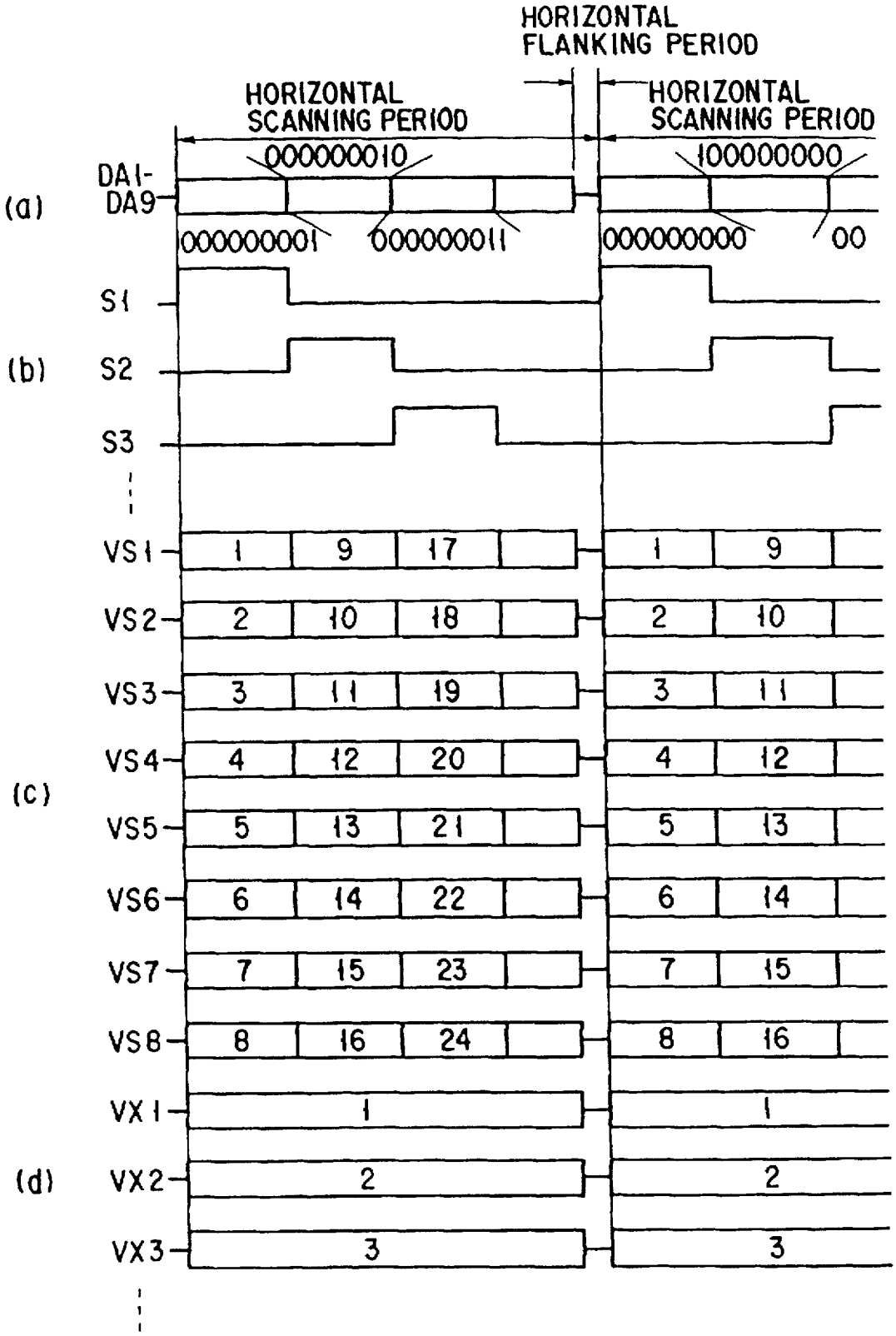
FIG. 8 is a view showing one drive waveform diagram of a video signal line drive circuit shown in FIG. 2.

As shown in FIG. 8(*a*), the 9-bit digital numeral signal DA1–DA9 is sequentially added by the count circuit or the like (not shown) in such a timing as to selectively output video data VD to the video signal line 163. In each timing, when the digital numeral signal DA1–DA9 is output by the counter (not shown) to the $2^8$ signal line, $2^7$ signal line, $2^6$ signal line, $2^5$ signal line, $2^4$ signal line, $2^3$ signal line, $2^2$ signal line, $2^1$ signal line and $2^0$ signal line of the numeral signal lines 312*a*, then the inverted replica DA10–DA18 of the digital numeral signals DA1–DA9 is output from an inverting output circuit (not shown) to the $2^9$ inverted signal line, $2^8$ inverted signal line, $2^7$ inverted signal line, $2^6$ inverted signal line, $2^5$ inverted signal line, $2^4$ inverted signal line, $2^3$ inverted signal line, $2^2$ inverted signal line, $2^1$ inverted signal line and $2^0$ inverted signal line.

For example, when the digital numeral signal DA1–DA9 from the counter circuit emerge as {0000000001}, then a {0} is supplied to the $2^8$ signal line, $2^7$ signal line, $2^6$ signal line, $2^5$ signal line, $2^4$ signal line, $2^3$ signal line, $2^2$ signal line, $2^1$ signal line and $2^0$ inverted signal line. Further, a {1} is supplied to the $2^9$ inverted signal line, $2^8$ inverted signal line, $2^7$ inverted signal line, $2^6$ inverted signal line, $2^5$ inverted signal line, $2^4$ inverted signal line, $2^3$ inverted signal line, $2^2$ inverted signal line, $2^1$ inverted signal line and $2^0$ signal line. In consequence, when the input digital numeral signal DA1–DA9 is {0000000001}, an output S1 is obtained from the first stage of the output control circuit section 331*a* as shown in FIG. 8(*b*).

Further, video signals VS1, . . . , VS8 are input to the eight video data lines 345*a* as shown in FIG. 8(*c*).

When the output S from the first stage of the output control circuit section 331*a* is placed in an ON period, the first to eighth video data select analog switches 343*a* are selected at a time and the respective video data VD1, . . . , VD8 are output to the first to eighth video signal lines 163.

Further, when an output S2 from the second stage of the output control circuit section 331*a* is placed during an ON period, the corresponding video data select analog switches 343*a* are selected at a corresponding time and the respective video data VD9, . . . , VD16 are output to the ninth to sixteenth video signal lines 163.

Thus, the video data VD1, . . . , VD1840 are output to the 1840 video signal lines 163 for each horizontal scanning period.

The video data VD delivered to the video signal line 163 is written into the pixel electrode 167 via TFT 165 during the period in which the scanning line 161 is selected, and a potential difference between the pixel electrode 167 and the common electrode 195 is held to display it during the period before the scanning line 161 is selected again.

Figure 9:
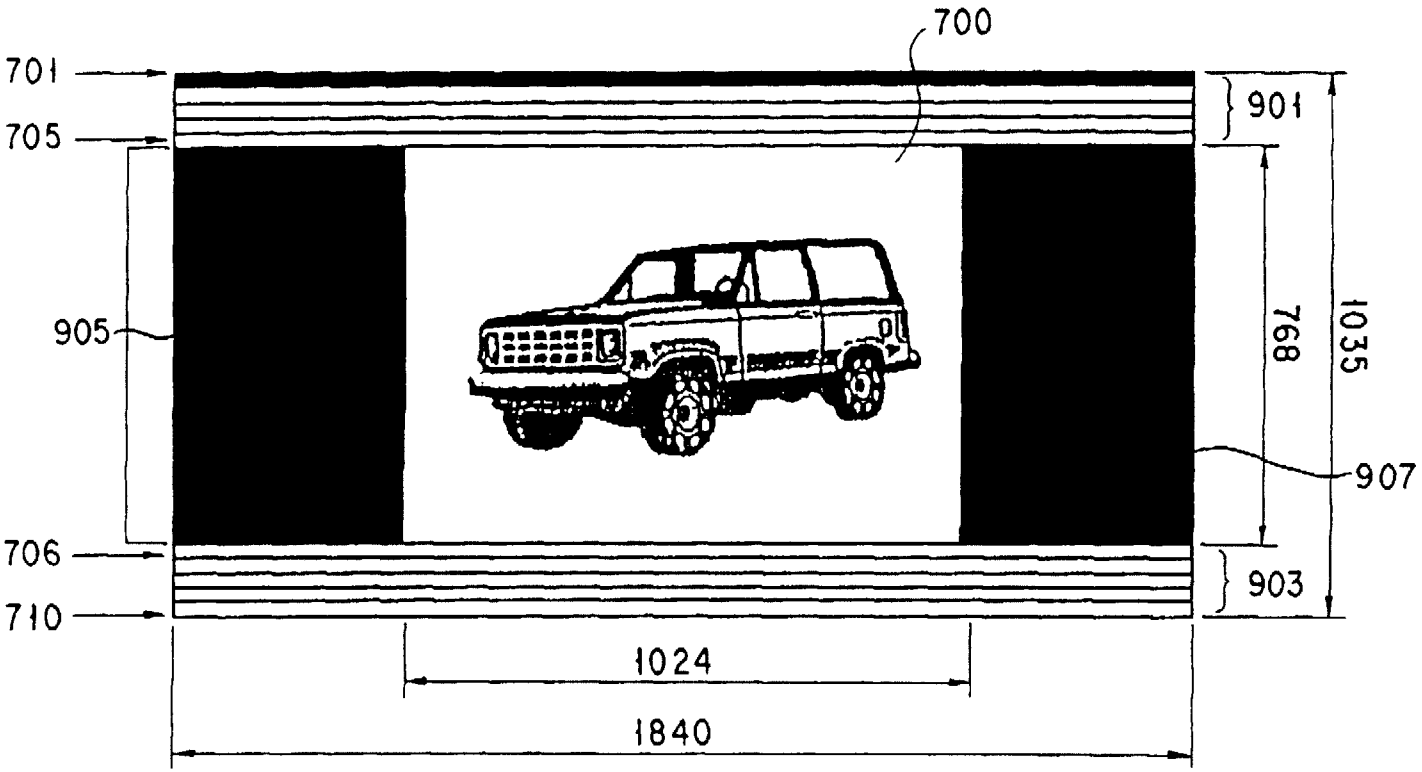
FIG. 9 is a view showing one form of an image displayed by the liquid crystal projector shown in FIG. 1.

The number of effective scanning lines and that of video data of the video signal VS can be smaller than the number of the horizontal pixel lines of the liquid crystal display device 101 and that of display pixels contained in the horizontal pixel line, respectively. Explanation will be given about effecting a display with the number of effective video data VD of the video signal VS being 1024 per effective scanning line and the number of effective scanning lines being 768 as shown in FIG. 9.

Here, explanation will be given below about effecting a display on a display area 700 by a sequential drive shown in FIG. 6 with non-display areas 901 and 903 comprised of 140 and 127 lines, respectively, at the top and bottom portions of the display area and with non-display areas 905 and 907 comprised of 408 display pixels, respectively, at the left and right sides of the display area as shown, for example, in FIG. 9.

In one vertical scanning period of a first field period, the scanning line drive circuit 201*a* shown in FIG. 2 selects the 141st to 908th horizontal pixel lines based on the 10-bit digital numeral signal SA1–SA10 which is sequentially increased from {0001000111} to {0111000110} by a ROM. In a first vertical blanking period of the first field period, the 1st to 28th horizontal pixel lines are sequentially scanned, as a first block 701, based on the 10-bit digital numeral signal SA1–SA10 which is sequentially increased from {0000000001} to {0000001110} by the ROM. In a fifth vertical blanking period of the subsequent fifth field period, the 113rd to 140th horizontal pixel lines are sequentially scanned, as a fifth block 705, based on the 10-bit digital numeral signal SA1–SA10 which is sequentially increased from {0000111001} to {0001000110} by the ROM. In a sixth vertical blanking period of the sixth field period, the 909th to 936th horizontal pixel lines are sequentially scanned, as a sixth block 706, based on the 10-bit digital numeral signal SA1–SA10 which is sequentially increased from {0111000111} to {0111010100} by the ROM. In a 10-th vertical blanking period of the subsequent 10-th field period, the 1021st to 1035th horizontal pixel lines are sequentially scanned, as a 10-th block 710, based on the 10-bit digital numeral signal SA1–SA10 which is sequentially increased from {0111111111} to {1000000110} by the ROM.

To the video input lines 345*a* of the video signal line drive circuit 301*a*, 1024 video data VD corresponding to the 409th to 1432th display pixels during one horizontal scanning period and a video signal containing non-display data VB corresponding to the 1st to 408th non-display pixels and non-display data VB corresponding to the 1433rd to 1840th non-display pixels during its horizontal blanking period are input.

During the vertical blanking period of each field period, non-display data VB corresponding to the 1840 display pixels are input to the video input lines 345*a*.

By doing so, the 136th to 903th horizontal pixel lines are sequentially selected during one vertical scanning period and the non-display data VB are displayed, as a first block 701, on the 1st to 28th horizontal pixel lines during its vertical blanking period. This being sequentially repeated, the non-display data VB are displayed on all the non-display areas 901 and 903 divided in 10 blocks.

It is sometimes difficult to transfer the non-display data VB corresponding to the 1st to 408th non-display pixels and non-display data VB corresponding to the 1433th to 1840th non-display pixels within the horizontal blanking period. In such a case, all the non-display data VB corresponding to the 1st to 408th non-display pixels and non-display data VB corresponding to the 1433rd to 1840th non-display pixels are not displayed during the same one horizontal scanning period but may be displayed in a way divided in a plurality of blocks.

The non-display areas 901 to 904 may be obtained by transferring the non-display data VB corresponding to the 1st to 80th non-display pixels for each horizontal blanking period during one vertical scanning period of the first field period, the non-display data VB corresponding to the 81st to 160th non-display pixels for each horizontal blanking period during one vertical scanning period of the second field period, and the non-display data VB corresponding to the 1752nd to 1840th non-display pixels for each horizontal blanking period during one vertical scanning period of the subsequent eleventh field period, for example.

Further, for each field period, the non-display pixels corresponding to the non-display data need not be made equal in respective horizontal pixel lines, and instead may be respectively made different. Therefore, it is possible to divide the non-display area into a plurality of blocks and display the non-display data on different non-display pixels for each horizontal pixel line. For example, during the first field period, the non-display data VB are displayed on the 1st to 80th non-display pixels with respect to the 141st to 142rd horizontal pixel lines, on the 81th to 146th non-display pixels with respect to the 143th and 144th horizontal pixel lines, and on the 161st to 240th non-display pixels with respect to the 145th to 142nd horizontal pixel lines. As for the 143th to 144th horizontal pixel lines, since the non-display data VB corresponding to the 1st to 80th non-display pixels are held in the horizontal capacitance sections 351*a* at the time of displaying the 141th and 142th horizontal pixel lines and remain there, the non-display data VB corresponding to the 1st to 80th non-display pixels need not be transferred. Accordingly, while the non-display data VB are displayed on the 1st to 80th non-display pixels, the non-display data VB are displayed on the 81th to 160th non-display pixels.

With the liquid crystal display device 101 arranged as described above, the display area 700 can easily be located at substantially the central area of the display screen by controlling the digital numeral signal input to the scanning line drive circuits 201*a* and 201*b* and video signal drive circuits 301*a* and 301*b*.

Regarding the video signal drive circuits 301*a* and 301*b*, it effectively utilizes the memory function of the storage capacitance section 351*a*, so that the non-display area can be obtained without using any specific frame memory or the like, even if a lot of non-display pixels are set in each horizontal pixel line.

The digital numeral signal SA1 to SA20 may be determined to select the 136th to 903th horizontal pixel lines during one vertical scanning period, and to sequentially select the 1st, 11st, 21st, . . . , horizontal pixel lines as a first block during a first vertical blanking period, the 2nd, 12nd, 22nd, . . . , horizontal pixel lines as a second block during the second vertical blanking line period, the 3rd, 13rd, 23rd, . . . , horizontal pixel lines as a third block during the third vertical blanking period, and the 10th, 20th, 30th, . . . , horizontal pixel lines as a 10th block during . . . 10th vertical blanking period.

Since the non-display areas 901 and 903 are dividedly driven, the horizontal pixel lines constructing the non-display areas 901 and 903 selected during one vertical blanking period are uniformly dispersed in a display screen as compared with the above-mentioned procedure. Therefore, even if the number of blocks dividing the non-display areas 901 and 903 is increased, it is possible to attain a better display image without involving a flicker, etc.

Although, in this embodiment, the non-display areas 901 and 903 are divided into 10 blocks in the vertical scanning direction and the non-display data (VB) are written onto every horizontal pixel line of the non-display areas 901 and 903 during the 10-times vertical blanking period, needless to say, all the horizontal pixel lines constituting the non-display areas 901 and 903 are selected at a particular time.

The same thing can also be said about the case where the non-display data (VB) is written in one horizontal pixel line.

In the case where, as set out above, the number of effective scanning lines for the video signals VS and that of the video data VD are smaller than the number of the horizontal pixel lines of the liquid crystal device 101 or the number of display pixels constituting one horizontal pixel line, it follows that, according to the liquid crystal projector 1 shown in FIG. 1, the display area 700 and non-display areas 901, 903, 905 and 907 are displayed on the screen 41 as shown, for example, in FIG. 9.

In such a case, the liquid crystal projector 1 may be arranged such that a decrease in the number of effective scanning lines of the video signal VS or the number of effective video data VD is detected, and the magnification of the projecting lens 31 thereof is increased based on the result of detection. Thus, even when the number of effective scanning lines of the video signal VS or the number of effective video data VD varies, it is possible to obtain a display area 700 of a substantially constant size on the screen 41 at all times.

As described above, according to the liquid crystal device 101 of the present invention, the respective scanning lines 161 and analog switches 343*a* for respective video data selection are selected responsive to the input digital numeral signals SA1–SA20 and DA1–DA18. Thus, according to the liquid crystal display device 101 of this embodiment, the scanning lines 161 and video data select analog switches 343*a* are sequentially selected as set out above and, in addition, it is also possible to select any scanning lines 161 and video data select analog switches 343*a* by the digital numeral signals SA1–SA20 and DA1–DA18 applied to the numeral signal lines 212*a* and 312*a*.

According to the liquid crystal projector 1 of this embodiment, even if the number of horizontal pixel lines differs from that of the effective scanning lines of the video signal VS or even if the number of the display pixels constituting one horizontal pixel line differs from that of the video data VD constituting one effective scanning line, it is possible to obtain a display area and non-display areas at any location on the display screen.

According to the liquid crystal projector 1 of this invention, even if the number of horizontal pixel lines greatly differs from that of effective scanning lines of the video signal VS or even if the number of display images constituting one horizontal pixel line greatly differs from that of video data VD constituting one effective scanning lines, it is possible to obtain a display area and non-display areas at any location on the display screen by dividedly scanning the horizontal pixel lines of the non-display area during plural vertical blanking periods or dividedly applying the non-display data VB to the display pixels of the non-display area during plural horizontal blanking periods of the vertical scanning period.

Although, in this embodiment, the display area is located at substantially the central area of the display screen as set out above, the present invention is not restricted thereto. The display area can be located in any position by controlling the digital numeral signals SA1–SA10 and DA1–DA9. It is also possible to prepare for a multi-image screen.

Further, the respective scanning lines 161 and video data select analog switches 343*a* can be selected in any sequence by controlling the increment and decrement of the digital numeral signals SA1–SA10 and DA1–DA9. As already set out, the liquid crystal projector 1 of this embodiment is comprised of, for example, three substantially similar liquid crystal display devices 101, 501 and 601. As evident from FIG. 1, however, the number of inversions of an image transmitted through the liquid crystal display device 501 only becomes odd-numbered, and it is necessary that different handling be effected in that device in view of the select sequence of the video data select analog switches 343*a* or the select sequence of the scanning lines 161 in the other liquid crystal display devices 101 and 601. According to this embodiment, however, it is possible to use three common liquid crystal display devices 101, 501 and 601 simply by connecting only the digital numeral signal, which is input to the liquid crystal display device 501, to the counter circuit for outputting the sequentially subtracting digital numeral signal. It is better, in this case, to make the display pixel configurations of the respective liquid crystal devices 101, 501 and 601, substantially equal to its configuration even if the transmitted light is inverted.

According to the present invention, it is possible to mirror-invert the display image and, by setting the digital numeral signals SA1–SA10 and DA1–DA9 from the counter or ROM, etc., to readily effect switching between when the display image from the liquid crystal projector 1 is displayed on a transmission type screen and when the image is displaced on a reflection type screen.

Although, in this embodiment, the input numeral signals SA1–SA20 for operating the scanning line drive circuit 201*a* constitute a 10-bit configuration and the input numeral signals DA1–DA18 for operating the video signal line drive circuit 301*a* constitute a 9-bit configuration, the scanning line drive circuit 201*a*, for example, is such that the maximal controllable number of scanning lines 161 becomes 1024 by a combination of connections at the matrix connection section 213*a* in the scanning line drive circuit 201*a*, for example.

In this embodiment, however, the scanning select circuit section 221*a* is provided between the matrix connection section 213*a* and the scanning lines 161, whereby it is possible to effect various types of drives and to control 1035 scanning lines 161 without involving an undue increase in the bit number of the input numeral signals (SA1–SA20).

However, a corresponding measure may be taken by increasing the number of bits of the input numeral signal or, conversely, in the case where the number of video signal lines 163 or number of scanning lines 161 is small, it is possible to decrease the number of bits of the input numeral signals.

Although, in the above-mentioned embodiment, a cumbersome connection operation is eliminated by forming the scanning line drive circuits 201*a*, 201*b* and video signal line drive circuits 301*a*, 301*b* integrally over the substrate 113 as shown in FIG. 2, it may be possible to construct them as an external circuit using a discrete IC, etc.

It may be possible that either one of the scanning line drive circuits 201*a*, 201*b* and video signal line drive circuits 301*a*, 301*b* or one of sets of drive circuits 201*a*, 201*b* and 301*a*, 301*b* is constructed of a plurality of stages of shift registers as in the conventional structure or a different connection configuration is adopted between the numeral signal lines 212*a* and the logic circuit section 215*a* at the matrix connection section 213*a* with the scanning line drive circuits 201*a*, 201*b* on both sides.

Although, in the embodiment, explanation has been given about the case where the high polymer diffused type liquid crystal is employed, which can largely enhance the light utilization efficiency because of eliminating any polarizing plate, etc., the present invention is not restricted thereto and use can be made of conventionally known types of liquid crystal materials.

Between the pixel electrode and the common electrode, for example, a nematic liquid crystal with a positive dielectric anisotropy (not shown) may be held, as the respective liquid crystal display devices 101, 501 and 601, to allow liquid crystal molecules to be twisted 90° twisted through opposed alignment films on these electrodes so that a polarizing plate is arranged on the outer surface of the substrate to align the polarization axis with the alignment axis.

Figure 10:
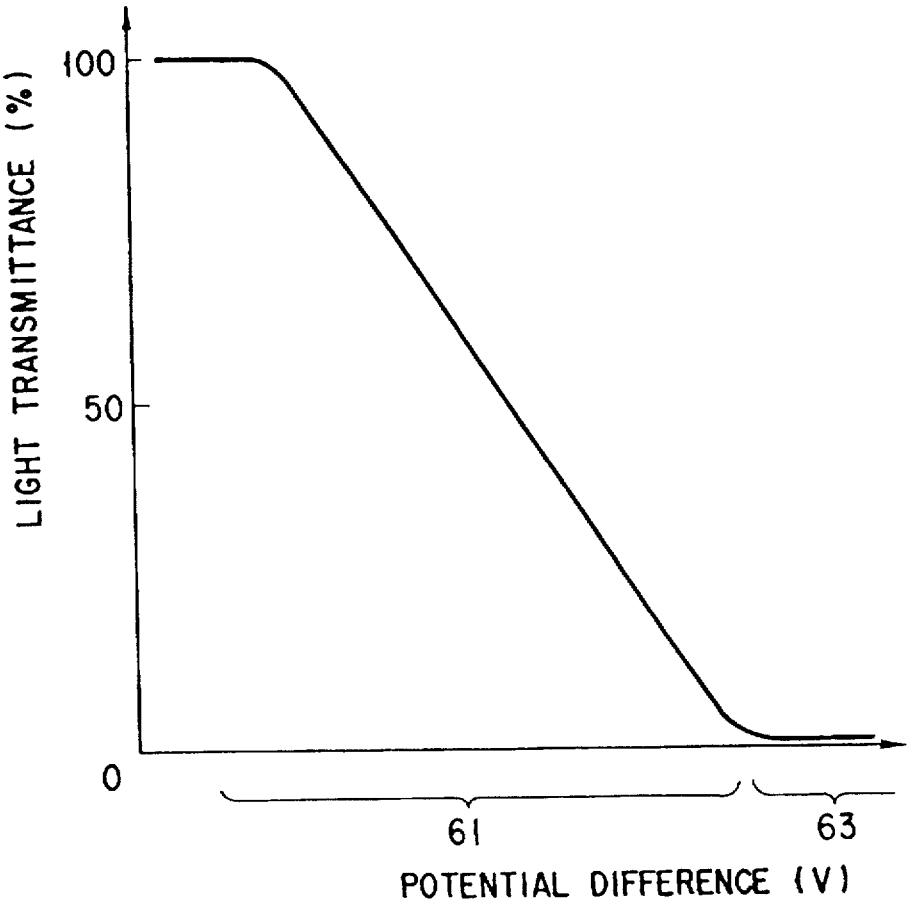
FIG. 10 shows a voltage-light transmittance characteristic illustrating a relationship between of the transmittance and a voltage between a pixel electrode and a common electrode of the liquid crystal device shown in FIG. 1.

Thus, the so-called normally white mode liquid crystal devices 101, 501, 601 are constructed in which, as shown in FIG. 10, when a potential difference between the pixel electrode and the common electrode is at a 0 V the transmittance becomes maximal and decreases with an increasing potential difference.

According to the liquid crystal projector 1 using the thus constructed normally white mode liquid crystal display deices 101, 501 and 601, when the non-display data VB are written into the non-display areas 901, 903 and 905, 907 shown in FIG. 9, a drive voltage is selected in a potential difference region 63 other than the potential difference region 61 across the pixel electrode, and the common electrode which may be taken in a normal display state and, by doing so, the non-display areas 901, 903 and 905, 907 are divided as a plurality of blocks. Thus, if display is completed in a plurality of blocks, it is possible to secure a better black display.

Although in this embodiment the liquid crystal projector 1 comprised of the three liquid crystal display devices 101, 501 and 601 has been explained by way of example, needless to say, it may be constructed of one crystal display device. Further, the optical system used may be made from various types of systems and the liquid crystal display device may be of a direct-viewing type.

Although in this embodiment the liquid crystal pixels have been explained as the display element, the present invention can be effectively applied if use is made of a display device having an element capable of light modulation, such as a display element whose light transmittance or reflectance varies in accordance with a drive voltage and a display element whose light emitting amount varies by a drive voltage.

Further, according to this embodiment, the respective numeral signal converting circuit sections may be altered to allow predetermined nothing-producing digital numeral signals, such as all 0 bits, to be inserted between any digital numeral signal trains. Since the predetermined digital numeral signals prevent the duplication of output pulses, it is possible to stably operate the display device.

Industrial Applicability

According to the display device of the present invention, since fewer logic circuit sections are provided than the number of scanning lines or signal lines for selective outputting by the scanning circuit section or video signal supply circuit section on the basis of the input numeral signals from the select control circuit section, it is possible to, for the high definition of the display device, prevent an increase in the number of connections and of logic circuit sections transmitting numeral signals and hence to manufacture devices in a high yield.

Further, according to the drive method for the display device of the present invention, even if the number of horizontal pixel lines of the display panel and effective scanning lines of the video signals, or the number of display pixels constituting one horizontal pixel line and number of video data of video signals, differ, it is possible to display non-display data on non-display areas by, for example, displaying non-display data in a first period on at least one horizontal pixel line not corresponding to the effective scanning lines of the video signals while, at the same time, displaying non-display data, in a second period different from the first period, on a horizontal pixel line not corresponding to the effective scanning line of the video signals or by displaying non-display data, in a first period, on at least one display pixel not corresponding to video data while, at the same time, displaying non-display data, in a second period different from the first period, on other display pixels not corresponding to the video data. By, providing a logic circuit section for effecting the selective outputting of the scanning circuit section or video signal supply circuit section on the display device, it is possible to readily realize the above-mentioned drive method in a simpler circuit arrangement.

We claim:

1. A display device comprising:

a display panel having a display screen constructed by a plurality of signal lines and a plurality of scanning lines arranged in a matrix, switching elements electrically connected to said signal lines and scanning lines and pixel electrodes connected to said switching elements;

a select control circuit section for generating an n-bit input numeral signal, n being a positive integer equal to or greater than 2, and an inverted replica of the input numeral signal and for controlling the n-bit input numeral signal so as to locate a display area at a position variable within the display screen; and a video signal supplying circuit section for selecting, in predetermined timings, input video signals based on the input numeral signal and the inverted replica of the input numeral signal from said select control circuit section, and supplying selected video signals to said signal lines as video data, wherein said video signal supplying circuit section includes:

an input connection line group having sets of input connection lines for receiving bits of the input numeral signal and bits of the inverted replica of the input numeral signal, a plurality of logic circuit sections, fewer in number than said scanning lines, for responding to combinations of the input numeral signal and the inverted replica of the input numeral signal, and output distributing means for assigning an output from one logic circuit section to at least two signal lines.

2. The display device according to claim 1, wherein each logic circuit section comprises a first logic circuit connected to different input connection lines of one set, a second logic circuit connected to different input connection lines of another set and a third logic circuit for responding to outputs of said first and second logic circuits.

3. The display device according to claim 1, wherein said video signal supplying circuit section comprises a plurality of video signal input lines for receiving the video signals and analog switching means for obtaining a plurality of video data from said video signal input lines on the basis of an output of one logic circuit section.

4. The display device according to claim 1, wherein said switching elements and video signal supplying circuit section are integrated on one substrate for said display panel.

5. A method for driving a display device for displaying a display image based on video data of a video signal on a display panel including a display screen constructed by an array of horizontal pixel lines each having a plurality of display pixels, the method comprising:

supplying an n-bit input numeral signal and an inverted replica of said input numeral signal;

displaying non-display data in a first period on at least one horizontal pixel line not corresponding to an effective scanning line of the video signal when the number of effective scanning lines in one vertical scanning period of the video signal is less than the number of said horizontal pixel lines, said display of the non-display data in the first period being based on said input numeral signal; and displaying non-display data in a second period different from the first period on another horizontal pixel line not corresponding to the effective scanning line of the video signal, thereby locating a display area on any position of the screen.

6. The method according to claim 5, wherein the first and second periods are a vertical blanking period of the video signal.

7. The method according to claim 5, wherein said display panel is a liquid crystal panel formed of an array substrate having a pixel electrode arranged in a matrix array, a counter substrate having a counter electrode arranged opposite to said pixel electrode, and a liquid crystal cell held between said array substrate and said counter substrate.

8. The method according to claim 7, wherein a potential difference for displaying non-display data is determined to be outside a range of a potential difference set between said pixel electrode and said counter electrode to display video data.

9. The method according to claim 5 which comprises a scanning circuit section including a scanning control circuit section for supplying the n-bit input numeral signal (n: 2 or more positive integer) and the inverted replica of the input numeral signal, an input connection line group having sets of input connection lines for receiving bits of the input numeral signal and bits of the inverted replica of the input numeral signal so as to select at least one horizontal pixel line corresponding to the input numeral signal and the inverted replica of the input numeral signal, and logic circuit sections for responding to combinations of the input numeral signal and the inverted replica of the input numeral signal.

10. A method for driving a display device for displaying a display image based on video data of a video signal on a display panel including a display screen constructed by an array of horizontal pixel lines each having a plurality of display pixels, the method comprising the steps of:

supplying an n-bit input numeral signal and an inverted replica of said input numeral signal;

displaying non-display data, in a first period, on at least one display panel not corresponding to the video data, said display of said non-display data in the first period being based on said input numeral signal; and displaying non-display data in a second period different from the first period, on another display pixel not corresponding to the video data, wherein the non-display data is displayed in the first and second periods when the number of the video data in one horizontal scanning period of the video signal is less than the number of said display pixels of the horizontal pixel line, thereby locating a display area on any position of the display screen.

11. The method according to claim 10, wherein the first and second periods are one horizontal blanking period of the video signal.

12. The method according to claim 10, wherein said display panel is a liquid crystal panel formed of an array substrate having said pixel electrodes arranged in a matrix array, a counter substrate arranged opposite to said pixel electrode, and a liquid crystal cell held between said array substrate and said counter substrate.

13. The method according to claim 12, wherein, a potential difference for displaying non-display data is determined to be outside a range of a potential difference set between said pixel electrode and said counter electrode to display video data.

14. A display device comprising:

a display panel having a display screen constructed by a plurality of signal lines and a plurality of scanning lines arranged in a matrix array, a plurality of switching elements electrically connected to said signal lines and scanning lines, pixel electrodes connected to said switching elements, and an array of horizontal pixel lines each comprised of a plurality of display pixels;

a scanning control circuit section for controlling an n-bit input numeral signal, n being a positive integer equal to or greater than 2, to locate a display area at a position variable within the display, and for supplying an n-bit input numeral signal and an inverted replica of the input numeral signal;

a scanning circuit section comprising an input connection line group having sets of input connection lines for receiving bits of the input numeral signal and bits of the inverted replica of the input numeral signal to select at least one scanning line corresponding to the input numeral signal and the inverted replica of the input numeral signal and logic circuit sections for responding to combinations of the input numeral signal, wherein said scanning control circuit is arranged such that, when the number of effective scanning lines in one vertical scanning period of the video signal is less than the number of the corresponding horizontal pixel lines, the input numeral signal is output to display non-display data in a first period on at least one horizontal pixel line of the video signal and display non-display data in a second period different from the first period on another horizontal pixel line not corresponding to said effective scanning line of the video signal.

15. The display device according to claim 14, further comprising a projection optical system for projecting on a screen a display image corresponding to the video signal.

16. The display device according to claim 15, further comprising adjusting means for adjusting said projection optical system for making the display image on said screen substantially equal between when the number of said effective scanning lines in one vertical scanning period of the video signal is less than the number of the corresponding horizontal pixel lines and when the number of the effective scanning lines in one vertical scanning period of the video signal is substantially equal to the corresponding horizontal pixel lines.

17. A display device comprising:

a display panel having a display screen constructed by a plurality of signal lines and a plurality of scanning lines arranged in a matrix array, a plurality of switching elements electrically connected to said signal lines and scanning lines, pixel electrodes connected to said switching elements;

a scanning circuit section for supplying scanning signals to said scanning lines; and a scanning control circuit section for controlling an n-bit input numeral signal, n being a positive integer equal to or greater than 2, to locate a display area at a position variable within the display screen, and for supplying the n-bit input numeral signal and an inverted replica of the input numeral signal to said scanning circuit section, said scanning circuit section having:

an input connection line group having sets of input connection lines for receiving bits of the input numeral signal and bits of the inverted replica signal, and a plurality of logic circuit sections, fewer in number than said scanning lines, for responding to combinations of the input numeral signal and the inverted replica of the input numeral signal.

18. A display device comprising:

a display panel having a display screen constructed by a plurality of signal lines and a plurality of scanning lines arranged in a matrix, switching elements electrically connected to said signal lines and scanning lines and pixel electrodes connected to said switching elements;

a select control circuit section for generating an n-bit input numeral signal, n being a positive integer equal to or greater than 2, and an inverted replica of the input numeral signal and for controlling the n-bit input numeral signal to locate a display area at a position variable within the display screen; and a video signal supplying circuit section for selecting, in predetermined timings, input video signals based on the input numeral signal and the inverted replica of the input numeral signal from said select control circuit section, and supplying selected video signals to said signal lines as video data, wherein said video signal supplying circuit section includes:

an input connection line group having sets of input connection lines for receiving bits of the input numeral signal and bits of the inverted replica of the input numeral signal, and a plurality of logic circuit sections, fewer in number than said scanning lines, for responding to combinations of the input numeral signal and the inverted replica of the input numeral signal.

* * * * *